United States Patent [19]

Bihler

[11] Patent Number: 4,916,929

[45] Date of Patent: Apr. 17, 1990

[54] METHOD AND APPARATUS FOR THE PRODUCTION OF PART-CIRCULAR ARC ELEMENTS

[76] Inventor: Otto Bihler, Schleiferweg 2, D-8959 Halblech, Fed. Rep. of Germany

[21] Appl. No.: 152,252

[22] Filed: Feb. 4, 1988

[30] Foreign Application Priority Data

Feb. 17, 1987 [DE] Fed. Rep. of Germany ..... 3704989

[51] Int. Cl.[4] ..... B21D 11/10; B21D 7/02; B21D 53/10

[52] U.S. Cl. ..... 72/203; 72/217

[58] Field of Search ..... 29/149.5 C, 149.5 DP, 29/149.5 S; 72/130, 131, 133, 203, 216, 217, 218, 219, 411

[56] References Cited

U.S. PATENT DOCUMENTS

| | | | |
|---|---|---|---|
| 78,418 | 6/1868 | Boyd | 72/219 |
| 100,903 | 3/1870 | Jordan | 72/217 |
| 842,500 | 1/1907 | Schneider | 72/411 |
| 2,382,901 | 8/1945 | Newsome et al. | 72/219 X |
| 3,949,491 | 4/1976 | Gregoire | 72/219 X |
| 4,351,175 | 9/1982 | Ichikawa et al. | 72/203 |
| 4,384,467 | 5/1983 | Ranft | 72/217 |
| 4,658,500 | 4/1987 | Engel et al. | 29/149.5 S |

FOREIGN PATENT DOCUMENTS

| | | | |
|---|---|---|---|
| 59-185525 | 10/1984 | Japan | 72/411 |

*Primary Examiner*—E. Michael Combs
*Attorney, Agent, or Firm*—Toren, McGeady & Associates

[57] ABSTRACT

For the production of arc elements of disc form a metal strip of wedge form is rolled on edge around an axis of curvature, the metal strip side faces, which converge on one another in wedge form, being rendered parallel.

The invention relates to a method for the production of a part-circular arc element the cross-sectional area of which—considered in a section containing the axis of curvature—possesses a, preferably longer, extent in the radial direction and a, preferably shorter, extent in the axial direction and the side faces of which, which are perpendicular to the axis of curvature, are substantially plane-parallel, especially of a check flange for a plain bearing shell.

26 Claims, 5 Drawing Sheets

METHOD AND APPARATUS FOR THE PRODUCTION OF PART-CIRCULAR ARC ELEMENTS

BACKGROUND OF THE INVENTION

Plain bearing shells with check flanges are required in many technical fields where the object is to support in the axial direction a shaft mounted rotatably by plain bearings. By way of example such plain bearing shells with check flanges are used for the bearing mounting of crank-shafts in internal combustion engines. However by way of example the invention is also of interest where it is desired to apply collars to plain bearing shells in order to secure the plain bearing shells themselves axially in a bore accommodating them.

STATEMENT OF THE PRIOR ART

According to one modern production method the production of the plain bearing shells with check flange or flanges takes place in a manner in which the check flanges are separately produced as part-circular arc elements and then spot-welded with the plain bearing shells.

The check flanges must frequently be provided, with a view to good axial bearing properties, with a high-grade running surface, especially with coatings of bearing metal such as Al Sn or Cu Sn. These bearing materials are costly not only on account of the materials utilised but especially also on account of the production method by rolling of the bearing metal on to a steel underlayer and on account of the high quality demands of surface quality and wall thickness constancy. Hitherto, specifically with regard to the high quality demands, the check flanges were stamped as semi-circular arcs from steel strip coated with bearing metal. The check flanges were in this case punched with the line of connection of their ends lying transversely of the strip longitudinal direction and considerable cutting waste occurred amounting to 50% or more of the total material consumption. Then the facettes frequently required on check flanges had to be provided on the stampings thus obtained. As a rule this could not be effected with the necessary precision of production by impressing, so that at least one swarf-removing finishing working was necessary. In all these working steps very careful attention had to be given to the obtaining of a satisfactory running surface. A possibility of finishing working of this sliding surface would consist at the ultimate in a regrinding, which necessitates a further expensive operation and requires a thicker bearing metal coating in view of this operation.

Object of the Invention

Now surprisingly it has been found that part-circular arc elements can be produced in the quality as required for bearing flanges of plain bearing shells according to a much more cost-favourable and moreover quality-improving method.

It is proposed that a substantially rectilinear metal strip section with two side faces inclined in wedge manner in relation to one another and with two edge faces connecting the side faces, namely an edge face close to the wedge tip and an edge face remote from the wedge tip, especially a metal strip section with sliding metal coating, is rolled on at least one of the side faces into the arc element, with the edge face close to the wedge tip producing the internal circumference and the edge face remote from the wedge tip producing the external circumference of the arc element.

When there is mention here of side faces inclined in wedge manner in relation to one another, this expression covers faces with rectilinear generatrix as also faces with curved generatrix, especially with concave generatrix. The form of the generatrices will be determined by simple prior experiments so that the most uniform possible deformation is achieved.

The sliding metal or other metal coating can be applied with uniform metal thickness; however it is also conceivable to apply the metal coating itself in wedge form, whereby account is taken of the deformation of the sliding metal. In this way it is for example possible to achieve the object that a wedge-shaped metal coating in deformation turns into a metal coating of uniform wall thickness.

In the application of the method according to the invention the material is stretched more on the edge face lying externally in relation to the axis of curvature than in the zone of the edge face closer to the axis of curvature. This leads to a different variation of wall thickness in the regions of the edge faces and in the side face regions lying therebetween. The wall thickness reduction is at the greatest in the region of the edge face remote from the axis of curvature and at the least in the region of the edge face close to the axis of curvature. Due to the fact however that commencement is made from a strip material of wedge-shaped cross-section, that is a metal strip section with two side faces inclined in wedge form in relation to one another, the different wall thickness variation can be compensated, so that the side faces are plane-parallel in the finished product, thanks to the rolling acting simultaneously upon the side faces. The essential advantage is then obtained that by the rolling operation the side faces are additionally smoothed and at the same time the wall thickness is equalised compared with the initial material. Thus it is possible to start from a material which is relatively cheap in view of lower quality requirements, because in the rolling operation an equalisation of wall thickness and a surface improvement occur. If one disregards the waste which occurs at worst on the arc ends, one can regard the method as practically waste-free.

The method is suitable for mass production on automatic punching and bending machines which are equipped with an appropriate rolling station. It is then advisable, with regard to large output numbers per unit of time, to work away from the reel or another long strip reserve, namely in a manner such that the metal strip section to be rolled in each case is formed by the leading end section of a longer metal strip. The rolling operation is here effected on the metal strip section in each case while this section is still connected with the longer metal strip, and only thereafter the rolled arc element is cut from the longer metal strip. In this way a simple material feed to the rolling station results by means of usual metal strip intake devices. The retention of the metal strip section to be rolled in each case in the rolling station can be taken over at least partially by the clamping of the following metal strip in each case in the intake device. After the severing of the rolled arc element this either drops into a collecting basket or is taken over by a further transport apparatus which can feed it to further processing stations. The latter procedure is here the preferred one.

It is advisable to effect the severing of the arc element at a point of the metal strip where the latter has already experienced a curvature by the rolling operation. This in fact means that the leading end of each metal strip section to be rolled already has a pre-curvature in the rolling of this metal strip section, so that an exact curvature is to be expected even in the region of the leading end where rolling is effected at the end of the rolling operation, although the rolling tools act there with a decreasing lever arm finally going towards 0.

One particular advantage of the method according to the invention consists in that the frequently necessary facettes, required especially at the transition between side faces and edge faces, occur without substantial after-working. It is in fact possible either to form the facettes of the finished arc element by rolling at the same time in the rolling operation by appropriate configuration of the tools, or to provide facettes already in the linear initial strip material, which facettes in rolling are either kept unaffected or rerolled by the rolling tools and thus further improved, that is experience a surface compacting.

In this way all hitherto necessary finishing operations by impressing and/or swarf-removing machining, for the production of ring facettes of the arc element, are eliminated.

The rolling operation can advantageously be carried out in a manner in which the metal strip section is rolled around a mandrel which possesses a substantially arcuate radially outwardly directed mandrel surface for the abutment of the edge face close to the wedge tip of the metal strip section and a substantially axially directed annular mandrel surface for the abutment of a side face of the metal strip section, and in which a roller is brought to act on each of the other side face and the edge face remote from the wedge tip, which rollers are moved commonly about the axis of the mandrel. It is here advisable that in the case of coating of one side face with bearing metal this side face is brought to abut on the axially directed annular mandrel surface and the uncoated side face is exposed to a roller. In this way the wall thickness of the bearing metal coating of about 0.5 mm. is substantially maintained while the material thickness variations are substantially restricted to the very much thicker steel layer. Naturally the bearing metal layer is also subject to a stretching. It is possible either to apply the bearing metal layer so thickly from the outset that even after the stretching it remains sufficiently thick in the zones subjected to the greatest stretching, or it is possible to make the bearing metal layer for its part in wedge form so that the bearing metal layer, taken in itself, becomes uniform over the whole radial width of the arc element, after rolling.

The rolled-out arc element is expediently severed from the longer metal strip on the mandrel by a cutting tool, and this cutting tool can co-operate with counter-cutting faces on the mandrel. In this way the strip section to be rolled in each case is held until the end of the rolling operation for the following bearing metal strip, and no special trimming of the ends of the arc element outside the mandrel is necessary. Here any desired shapes can be produced on the ends of the arc element by cutting off with selection of a suitable shaped plunger. By way of example the cut edges on the ends of the arc element can be cut to matching shapes, so that on assembling of two semi-circular arc elements to form a plain bearing check flange closed in ring form the two arc elements are centred against one another by matching projections and recesses.

Various after-shaping operations may be necessary on the arc element after rolling, without detriment to the advantageous progress of the method; thus it is advisable to form any necessary welding nipples on the arc element for the welding to a bearing half shell in a separate station into which the arc element can be transferred by a transport device after rolling. Likewise it is advisable for lubricating oil grooves which may be necessary in a side face of the arc element to be machined in a separate station, especially by a broaching action with a broach. In that case it is advisable to place these lubricating oil grooves radially in relation to the axis of curvature in order to produce no scoop action upon any lubricant film. It is however also conceivable to arrange the lubricant oil grooves in an inclined direction to a radius allocated to their respective locus. If the lubricant oil grooves are produced by broaching then their defining edges are in principle rectilinear and mutually parallel. It is however also conceivable to form the lubricant oil grooves in any form as early as on the strip to be worked, so that their edges experience a deformation in rolling. Admittedly in that case attention must be given so that the rolling operation is not disadvantageously influenced by the grooves proviouoly formed in the strip material.

The invention further relates to an apparatus for carrying out the production method. To this extent the invention faces the problem of indicating an apparatus with simplest possible assembly which delivers the half-arc elements either as finished products or as largely finished intermediate products. For the solution to this problem a rolling mandrel is proposed having a radially directed mandrel surface for the abutment of the edge face close to the wedge tip and a substantially axially directed mandrel face for the abutment of a side face of the metal strip section. There are further provided a first roller for action upon the other side face of the metal strip section and a second roller for action upon the edge face remote from the wedge tip of the metal strip section. These two rollers are mounted on a roller carrier which is pivotable about the axis of the rolling mandrel. The first roller is here mounted on the roller carrier about an axis substantially radial to the mandrel axis, while the second roller is mounted on the roller carrier about an axis substantially parallel to the mandrel axis. The roller carrier is in operational connection with a rotary drive. Naturally the converse solution is also possible, in which the roller carrier is stationary and the mandrel is rotatable.

It is also conceivable in place of a single second roller to use two second rollers which come into action in succession. The bending forces of the second roller acting upon the narrow side are in fact high, according to strip dimension and quality of the basic material, especially if the basic material is steel. On the other hand the narrow side is relatively small and under some circumstances rolled expansion could result laterally on the check ring due to the rolling bending forces. By two second rollers coming to effect in succession it would be possible to achieve the object that each of the two second rollers has to supply only a part of the bending forces and thus the pressures per unit area between the second rollers and the edge face influenced by them become correspondingly less.

A remark is needed at this point on the question of the rolling. Fundamentally a change of structure occurs in the material strip section due to the bending operation, in that in fact the zones remote from the axis of curvature are stretched more than the zones close to the axis of curvature. When there is mention here of a rolling operation, this is because a change of structure occurs in the metal strip.

The rolling operation, especially by the roller acting in the axial direction upon the metal strip, can further reinforce the change of structure, in that the metal strip is rolled down to a wall thickness which is less than that wall thickness which would result from mere bending. It is however also conceivable that the roller acting in axial direction upon the metal strip only ensures a surface smoothing, without itself contributing substantially to the change of structure, while the change of structure occurs essentially by the bending operation. Something similar is valid for the roller acting in radial direction upon the outer edge face, that is that remote from the wedge tip. This can be adjusted either so that it effects only a bending, or it can be adjusted so that it participates actively in the change of structure in the metal strip. Both possibilities are to be covered by the terms "rolling" and "roller".

In order to be able to introduce the metal strip into the gap formed between the mandrel and the roller, and to readjust it before each bending operation, it is advisable to make the rollers adjustable in relation to the respective mandrel surface so that the roller nip can be widened—possibly in both directions—before the metal strip is pushed in or caused to follow up, and thereafter the rolling nip can be narrowed—possibly in both directions—again in each case before the actual rolling operation begins. In any case a possibility of extension of the rolling nip in a direction perpendicular to the annular mandrel surface on which the one of the side faces of the strip material is rolled must exist.

One especially advantageous possibility of being able to widen and narrow the rolling nip, according to whether the metal strip is to be pushed forward or whether the actual rolling operation is to be carried out, consists in that the rollers are mounted on an eccentric and the eccentric is rotatable. In this way not only can the periodically necessary widening and narrowing of the rolling nip be effected, but it is also possible for a readjustment of the rollers to be effected when they have worn after a lengthy time of operation.

An especially high-grade product is obtained if the axes of rotation of the two rollers are arranged approximately in one common plane containing the axis of the mandrel. This measure achieves the object that the rollers act simultaneously on the same point of the circumference of the respective arc element, in the rolling operation.

In order that the strip material may be brought from the reel or another material reserve, with the mandrel there can be associated a metal strip feed device with a stationary and a movable tongs arrangement which delivers the metal strip to be worked tangentially to the mandrel.

In order that the arc element on the mandrel may be severed from the following metal strip, a cutting plunger for cutting the arc element which is rolled in each case from the following metal strip can be allocated to the mandrel. In this case with regard to the cross-sectional conditions of the arc element it is advisable that the cutting plunger is movable substantially perpendicularly of the annular mandrel surface.

In order to obtain clean cuts on the ends of the arc elements it is advisable that the cutting plunger should co-operate with counter-cutting edges which are formed by an aperture in the annular mandrel surface.

In order that such an aperture should not impair the rolling operation it is advisable that the aperture should be filled out by a counter-holder plunger which lies with an end face flush with the annular mandrel surface in the rolling operation and can be pressed back by the cutting plunger in the cutting operation. The counter-holder plunger here fulfills two functions, firstly the function of exerting a counter-force similarly to that in precision stamping, and nextly the function of removing any material waste from the deformation path again. It is advisable to let the counter-holder plunger act with a regulable or adjustable counter-force in dependence upon cutting force and material. The application of the counter-force can take place hydraulically or mechanically, possibly by a spring.

If it is intended to roll ring facettes on the arc element concerned, or to perform finishing work on longitudinal facettes already present from the strip material, it is possible to provide facette-working faces on the mandrel and/or on at least one of the rollers, which faces in the rolling form ring facettes on the corresponding arc element, or perform finishing work on facettes already pre-formed on the metal strip section.

BRIEF DESCRIPTION OF THE DRAWINGS

The invention is to be described in greater detail by reference to an example of embodiment.

DESCRIPTION OF THE PREFERRED EMBODIMENTS

Figure 8:
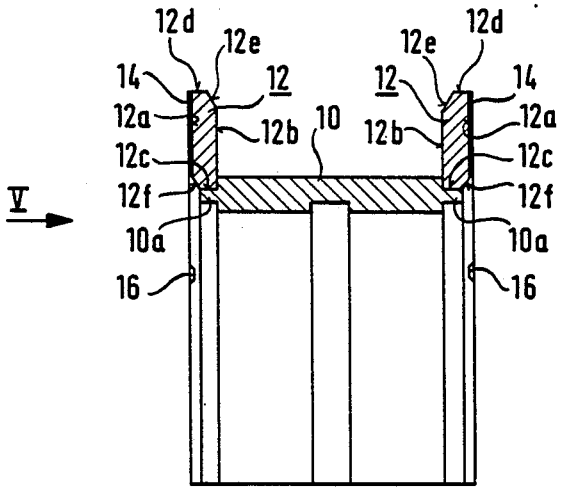
FIG. 8 shows a section containing the axis through a plain bearing shell with two check flanges.

In FIG. 8 a plain bearing shell of ordinary form is designated by 10, as one possible example of embodiment. Two check flanges 12 are welded by resistance spot welding to this plain bearing shell, which extends over approximately 180°. The nature of the joint between the plain bearing shell 10 and the check flanges 12 appears from the sectional illustration in FIG. 8. The check flanges 12 have a bearing metal coating 14 each on one side face **12*a*. The bearing metal coating is situated on the outer side faces 12*a* turned away from one another. The side faces 12*b* facing one another of the check flanges are plane-parallel to the surfaces of the bearing metal coating 14. The edge faces of the check flanges 12 near to the axis of curvature are designated by 12*c*; they lie on radially outwardly directed faces on axial projections 10***a* of the plain bearing shell 10. The edge faces of the check flanges remote from the axis of curvature are designated by 12*d*. Annular facettes 12*e* are situated at the transition between the side faces 12*b* and the edge faces 12*d*. Annular facettes 12*f* are situated at the transition between the side faces 12*a* and the edge faces 12*c*. The check flanges are represented individually in FIG. 5, namely in the direction of the arrow V in FIG. 8.

The projections 10*a* of the plain bearing shell 10 can either be localised projections which are essentially limited to the region of the welds, or it is conceivable to make the projections 10*a* as continuous annular ribs.

Figure 6:
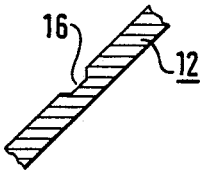
FIG. 6 shows a section along the line VI—VI in FIG. 5.
Figure 7:
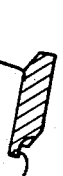
FIG. 7 shows a section along the line VII—VII in FIG. 5

Lubricant grooves 16 which extend radially in relation to the centre point K of curvature and are represented in enlarged manner in FIG. 6 are let into the running surfaces 12*a* coated with bearing metal 14. Weld nipples 18 are formed by embossing on the check flanges 12 in the region of the edge faces 12*c*, with the aid of which nipples the check flanges 12 are welded to the plain bearing shell 10 in the region of its axially directed projections 10*a*. The weld nipples 18 are represented individually in FIG. 7.

On the arc ends of the check flanges 12 there are cut projections 20*a* and recesses 20*b* which match one another so that identical check flanges 12 of plain bearing shells which belong together supplement one another to make the complete ring form, and are centrable against one another.

It is possible to imagine the assembly as somewhat consisting in that according to FIG. 8 the two flanges lie on both sides of a bearing flange of an engine block, the plain bearing shell 10 is received by an aperture of this bearing flange, the second plain bearing shell (not shown) rests on the inner side of an arc element which completes the aperture in the bearing flange to form a circular bearing bore and the check flanges 12 of this further plain bearing shell lie laterally on the arc. The faces 12*a*, coated with bearing metal 14, of the check flanges then lie against check flanges of a crank-shaft which is mounted rotatably in the plain bearing shells 10. Thus the crank-shaft is fixed in the axial direction. This arrangement can be made at both ends of the crank-shaft.

Figure 4:
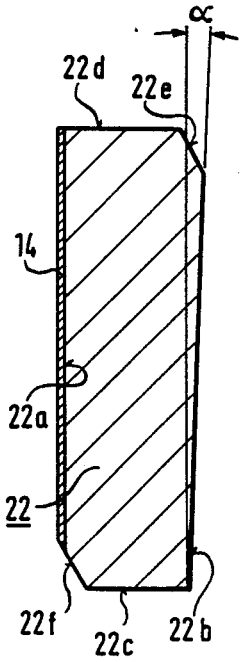
FIG. 4 shows a section along the line IV—IV in FIG. 1.

For the production of the check flange 12 commencement is made from a rectilinear metal strip 22, which is represented in FIG. 4. This metal strip comprises, using corresponding indexing as in FIG. 8, two side faces 22*a* and 22*b*, two edge faces 22*c* and 22*d* and two plane facettes 22*e* and 22*f*. The side faces 22*a* and 22*b* include with one another an acute angle x. The edge face 22*c* is the edge face close to the wedge tip and the edge face 22*d* is the edge face remote from the wedge tip. The side face 22*a* is provided with the bearing metal coating 14.

Figure 5:
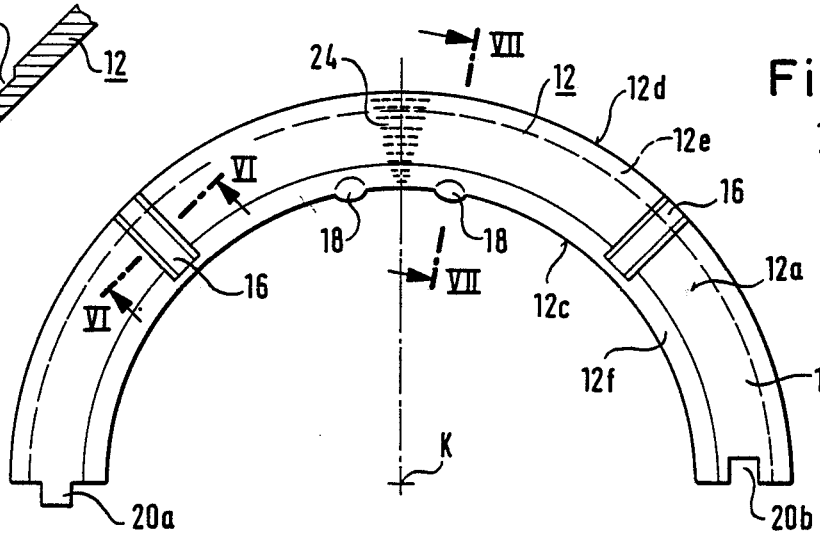
FIG. 5 shows an arc element produced on the apparatus according to FIGS. 1 to 3, namely a check flange for a plain bearing shell.

The check flange 12 is rolled according to FIG. 5 from such a rectilinear metal strip section. Great stretching occurs in this operation in those regions lying close to the edge face 12*d* remote from the wedge tip, while in those regions lying close to the edge face 12*c* close to the wedge tip, no stretching occurs, as a rule a material compression even occurs. The stretch conditions are indicated at 24 in FIG. 5. In this rolling operation the linear facettes 22*e* and 22*f* of the metal strip section become ring facettes 12*e* and 12*f*. The projections and recesses 20*a* and 20*b* are produced by trimming of the ends of the rolled check flange. The radially directed lubricant grooves 16 are formed into the side face 12*a* by broaching by means of a broach. The weld nipples 18 are formed by embossing after rolling.

Figure 1:
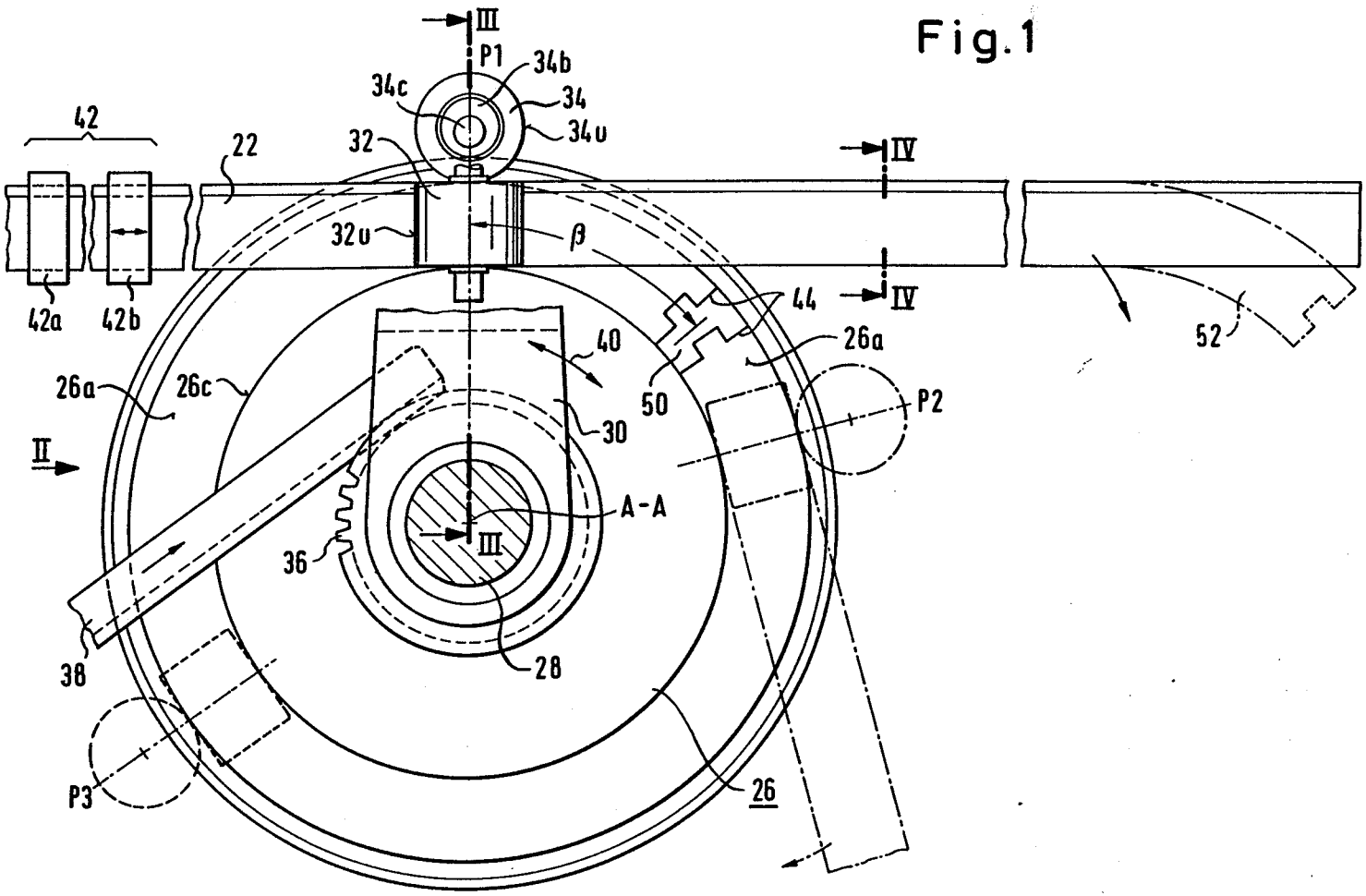
FIG. 1 shows a front view of an apparatus according to the invention.
Figure 2:
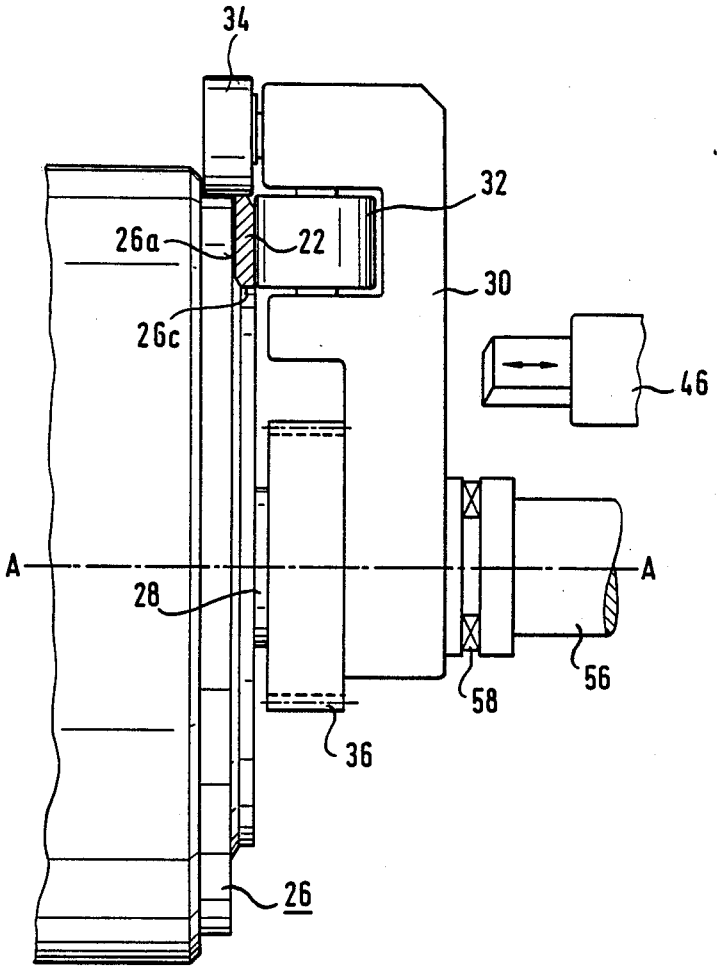
FIG. 2 shows a lateral view in the direction of the arrow II in FIG. 1.
Figure 3:
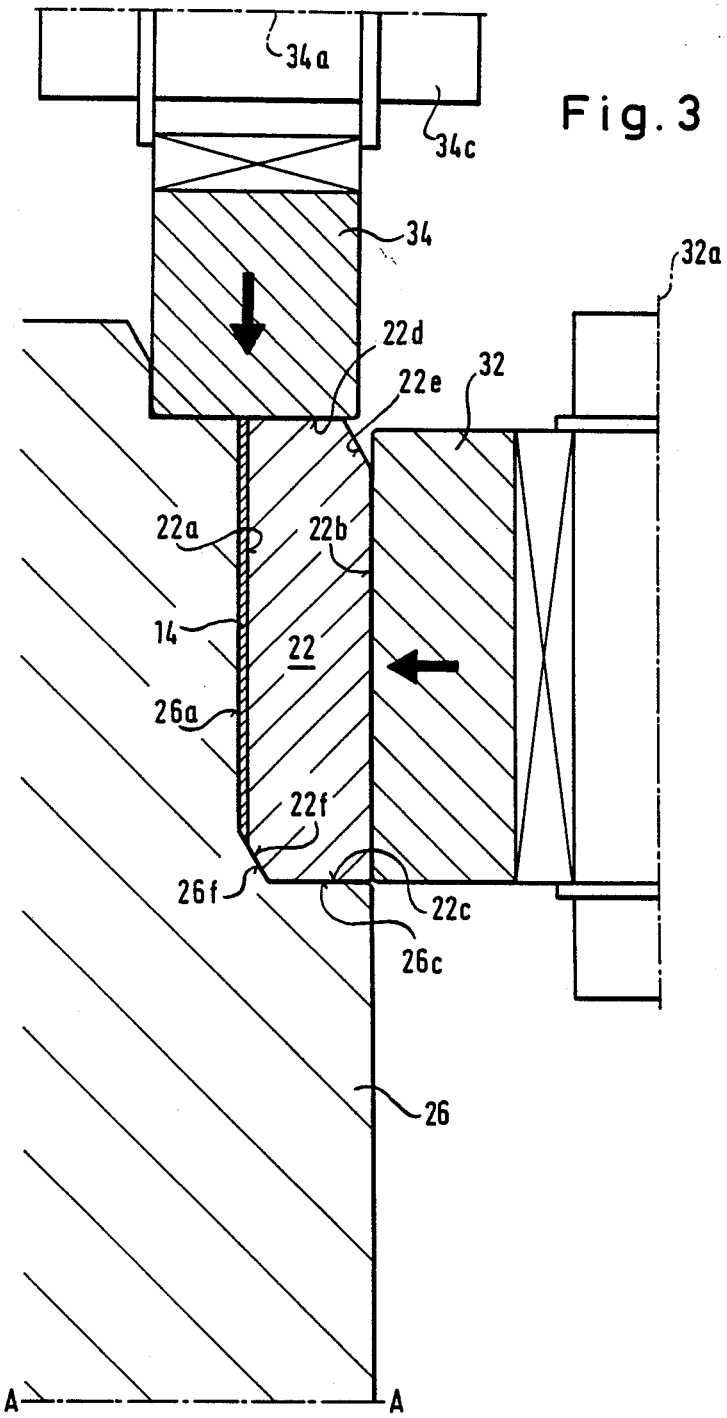
FIG. 3 shows a section along the line III—III in FIG. 1.

An apparatus for the production of the check flanges 12 is illustrated in FIGS. 1 to 3. In these Figures there may be seen a rolling mandrel 26. On this rolling mandrel there is formed a substantially cylindrical, possibly slightly elliptical, radially outwardly directed mandrel surface 26*c* for the abutment of the edge face 22*c* of the metal strip section 22, also an annular, axially directed mandrel surface 26*a* for the abutment of the metal strip section side face 22*a* coated with bearing metal 14. An oblique mandrel surface 26*f* for the abutment of the facette 22*f* of the metal strip section 22 is further formed on the mandrel.

The mandrel axis is designated by A—A. A roller carrier 30 is mounted rotatably on a shaft 28 coaxially united with the mandrel 26. On this first roller carrier 30 a first roller 32 is mounted, the axis 32*a* of rotation of which is radial in relation to the mandrel axis A—A, also a second roller 34, the axis 34*a* of rotation of which is parallel to the mandrel axis A—A. The two rollers 32 and 34, as represented in FIG. 1 only for the roller 34, are mounted on an eccentric 34*b* which is adjustable about a bearing journal 34*c* and can be secured in its adjustment. By rotation of the eccentric 34*b* in relation to the bearing journal 34*c* it is possible to vary the distance of the rolling face 34*u* from the mandrel surface 26. Correspondingly by means of an eccentric the rolling face 32*u* of the first roller 32 can be adjusted in relation to the mandrel surface 26*a*. This however is only one possible form of embodiment for the adjustment of the rolling faces in relation to the mandrel surfaces.

The roller carrier 30 is connected fast in rotation with a toothed wheel 36 which is drivable by a rack 38. In this way the roller carrier 30 is pivotable in the direction of the double arrow 40 about the mandrel axis A—A. Of course the rack is represented only as one drive possibility among others. The rack can be offset perpendicularly of the plane of the drawing in FIG. 1, so that it does not come into collision with the rollers 32 and 34 and their carrier 30.

A metal strip 22 can be brought by an intake device 42 tangentially to the mandrel 26. The intake device 42 comprises a stationary tongs arrangement 42*a* and a tongs arrangement 42*b* movable in the direction of the double arrow. This intake device successively feeds such a length of the metal strip 22 each time as is needed for the bending of a check flange 12. In order that the still unrolled metal strip 22 may be introduced into the gap (see FIG. 3) between the mandrel surface 26*a* and the first roller 32 for the one part and between the mandrel surface 26*c* and the second roller 34 for the other part, the rolling faces 34*u* and 32*u* are lifted, by actuation of the eccentric 34*b*, in each case so far from the mandrel surface 26*c* and 26*a* respectively that the still unrolled metal strip passes easily through the gap. At the beginning of the production of check flanges the metal strip 22 is pushed forward so far over the rollers 32 and 34, in their position shown in solid lines in FIG. 1, as corresponds to the circumferential length of a check flange increased by the arc interval $\beta$ between the rollers 32 and 34 for the one part and the countercutter faces 44 of a cutting plunger, still to be described. Then the rollers 32 and 34 are brought by renewed actuation of the eccentric 34*b* into the rolling position, that is close to the mandrel surfaces 26*a* and 26*c*. Now the rolling operation can begin: The roller carrier 30 is driven in the clockwise direction by the rack 38, the rollers 32 and 34 travelling from the position P1 by way of the position P2 into the position P3. In this action the leading metal strip section, which protrudes beyond the position P1, is bent round the mandrel 26 and at the same time rolled flat, so that the plane-parallel side faces 12*a* and 12*b* according to FIG. 8 are produced from the linear side faces 22*a* and 22*b*, initially inclined at an acute angle, according to FIG. 4. In this action the surface of the bearing metal coating is improved by the pressure application on the annular mandrel surface 26*a*. At the same time the annular facettes 12*e* and 12*f* of the abutment flange are produced from the facettes 22*e* and 22*f*. According to the setting of the rollers 32 and 34 in relation to the mandrel surfaces 26*a* and 26*c* a roll-bending action or a rolling action occurs. In any case rolling in the sense of a modification of structure should be expected between the roller 32 and the mandrel surface 26*a*, since by this rolling the stretching should be equalised, which is indicated at 24 in FIG. 5 and leads to parallelising of the side faces. The wall thickness of the bearing metal coating 14 is substantially uninfluenced by the rolling operation, but the stretching, which is indicated at 24 in FIG. 5, also occurs in the bearing metal coating 14.

Figure 9:
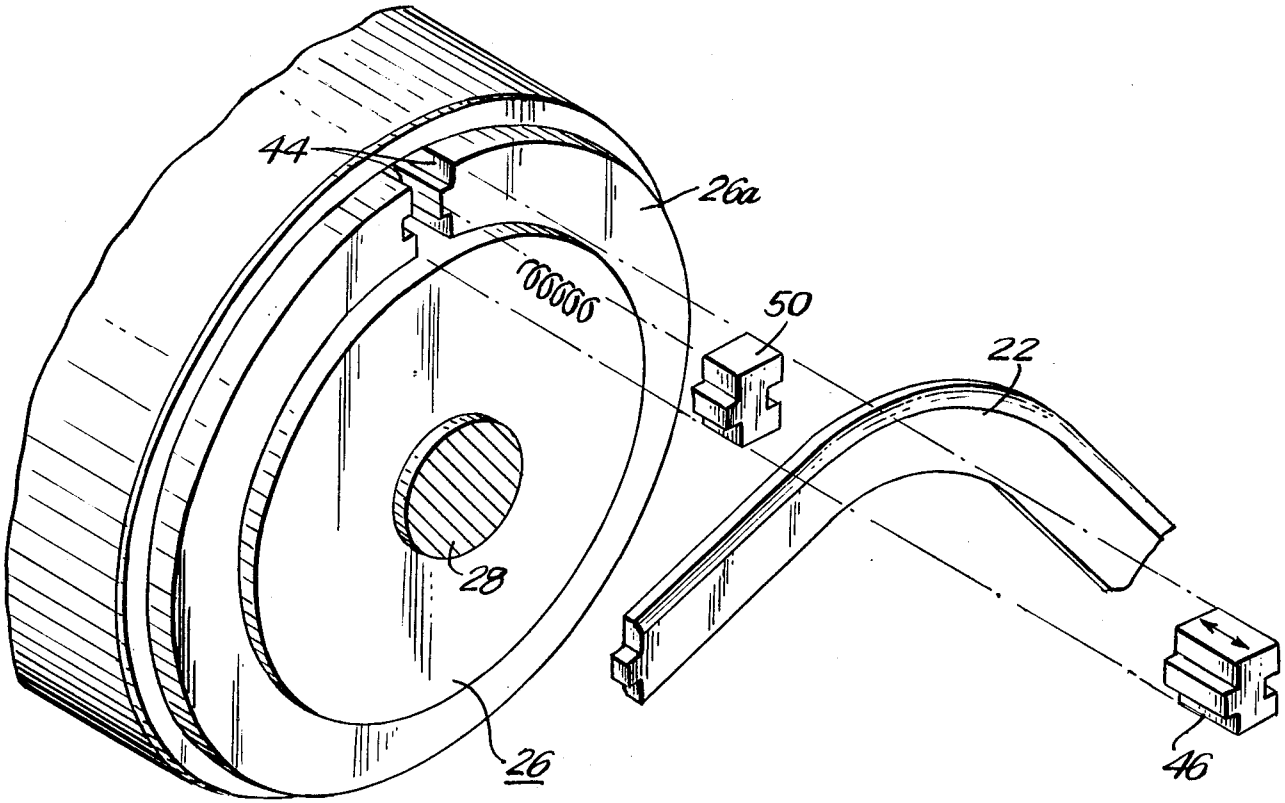
FIG. 9 shows a perspective view of the cutting means of the present invention.

After the rollers 32 and 34 have reached the position P3, the formed check flange is cut off by a cutting plunger 46, which is represented in FIG. 2 and is movable parallel with the axial direction A—A of the mandrel. This cutting plunger co-operates with the counter-cutter faces 44 which are arranged counter-sunk in the annular mandrel surface 26*a* as shown in FIG. 9. Here the shaft limited by the counter-cutter faces 44 can be filled out by a counter-holder tool 50 which in the cutting operation yields perpendicularly of the plane of the drawing in FIG. 1, perhaps against spring force. This counter-cutter tool 50 lies with its end face visible in FIG. 1 flush with the mandrel surface 26*a*, in the rolling operation, so that the rolling operation is not hindered by the counter-cutter faces 44 and no troublesome markings appear in the rolled metal strip.

After the first check flange has been rolled and cut off, the leading end of the metal strip 22 is curved over the arc region $\beta$. Now the roller carrier 30 with the rollers 32 and 34 is brought into the position P1 again. At the same time the rollers 32 and 34 are set back again from the mandrel faces 26*a* and 26*c*, so that the metal strip 22 can be pushed forward afresh by a length corresponding to the arc length of a check flange. After this advance has taken place, the metal strip 22 assumes the position as represented at 52 in FIG. 1. Now the next rolling operation can begin, in which the rollers 32 and 34 are again moved into the position P3. It is to be noted that here at the end of the rolling operation, shortly before the rollers 32 and 34 have reached the position P3, rolling is effected over a part of the metal strip section which already possesses a curvature from the preceding rolling operation. Thus the problem of the deformation of the strip section end in each case is substantially facilitated; this problem would otherwise exist because towards the end of the respective metal strip section the roller 34 would not be able to exert any more adequate bending action upon the metal strip, for lack of an available lever arm.

The cutting plunger 46 and the counter-cutter faces 44 are so formed, as may be seen from FIG. 1, that the desired end contours of the check flange 12 with the projections 20*a* and 20*b*, are already produced in the cutting off of the metal strip section rolled in each case.

The cut-off check flanges either drop into a basket or they are already taken over during cutting by a transport device which brings them into further working stations, especially into a station for pressing-on the weld nipples 18 and/or into a station for broaching the lubricant grooves 16.

It is also conceivable to form the facettes 12*e* and 12*f* by rolling only in the rolling in the rolling station according to FIGS. 1 to 3. It is however more favourable to introduce the linear metal strip according to FIG. 4 already with the facettes 22*e* and 22*f* into the rolling station, and if necessary perform finishing work on the facettes 22*e* and 22*f* in the rolling station.

The setting of the rollers 32 and 34 forward and back for the rolling operation and the follow-up of the metal strip 2 can readily be automated in that for example in the position P1 an appropriate servo-device meets the eccentric 34*b* and turns the respective roller in relation to the respective eccentric. In principle other possibilities are also conceivable for moving the rollers 32 and 34 between the strip introduction position and the rolling position. Thus in FIG. 2 a power unit 56 is illustrated which acts through a thrust bearing 58 upon the roller carrier 30. By reciprocating movement of the power unit 56 the roller carrier with the roller 32 can be brought into the rolling position and the strip introduction position. A similar solution is also conceivable for the roller 34.

It would be a further very advantageous possibility to mount the roller carrier with the two rollers so that the two rollers can be withdrawn into the passage position by one common movement, that is to say, considered in FIG. 2, a movement of the two rollers 32 and 34 at 45° to the right and upwards is possible. For this purpose the two rollers 32 and 34 could also be arranged on an intermediate carrier which in turn is guided at 45° on the carrier 30. The movement could be effected by a power unit.

The improvement of the surface of the bearing metal as discussed above is based upon a compacting and smoothing effect caused by the high pressure exerted by the roller 32 between the bearing metal layer and the annular mandrel surface 26*a*.

The working of the weld nipples and the oil grooves can take place on the same machine on which the rolling working takes place. Finally the welding of the plain bearing shells 10, or better expressed of the plain bearing half shells 10, with the check flanges 12 can take place on the same machine on which the rolling takes place.

I claim:

1. A method for producing a part-circular arc element (12), having a cross-sectional area which - considered in a section containing the axis of curvature - possesses a longer extent in the radial direction and a shorter extent in the axial direction and further having faces (12*a*, 12*b*) which are perpendicular to the axis of curvature and are substantially plane-parallel, the method comprising the steps of:

providing a substantially rectilinear metal strip section (22) having two side faces (22*a*, 22*b*) inclined in a wedge form towards one another and having two edge faces (22*c*, 22*d*) connecting the side faces (22*a*, 22*b*), namely an edge face (22*c*) close to the wedge tip and an edge face (22*d*) remote from the wedge tip, the metal strip section (22) having a cross-sectional area with a short axis substantially perpendicular to one of said side faces (22*a*, 22*b*) and a long axis perpendicular to said short axis, said wedge shape extending along a major part of said long axis;

providing a mandrel (26) having an axis and arcuate radially outwardly directed mandrel surface (26*c*) for abutment of the edge face (22*c*) close to the wedge tip and a substantially axially directed mandrel surface (26*a*) along said arcuate radially outwardly directed mandrel surface (26*c*) for abutment of one side face (22*a*) of the metal strip section (22); and rolling the metal strip section (22) around the mandrel (26) to form the arc element, the edge face (22*c*) close the wedge tip producing an internal circumference (12*c*) and the edge face (22*d*) remote from the wedge tip producing the external circumference (12*d*) over the arc element (12), the rolling step including providing roller means (32, 34) for acting upon each of the other side face (22*b*) and the edge face (22*d*) remote from the wedge tip, the roller means moving in common about the axis (A—A) of the mandrel (26), the roller means (32, 34) having a rolling action effecting a longitudinal stretching of the metal strip section along the length thereof, which stretching is at a maximum adjacent to the edge face (22*d*) remote from the wedge tip, and is reduced towards the edge face (22*c*) close to the wedge tip, the side faces (22*a*, 22*b*) inclined in wedge form towards one another being transformed into the substantially plane-parallel side faces (12*a*, 12*b*) of the arc element (12) by the stretching during rolling action of the roller means.

2. A method for producing a part-circular arc element (12), having a cross-sectional area which—considered in a section containing the axis of curvature—possesses a longer extent in the radial direction and a shorter extent in the axial direction and further having side faces (12*a*, 12*b*) which are perpendicular to the axis of curvature and are substantially plane-parallel, the method comprising the steps of:

providing a substantially rectilinear metal strip section (22) having two side faces (22*a*, 22*b*) inclined in a wedge form towards one another and having two edge faces (22*c*, 22*d*) connecting the side faces (22*a*, 22*b*), namely an edge face (22*c*) close to the wedge tip and an edge face (22*d*) remote from the wedge tip, the metal strip section (22) having a cross-sectional area with a short axis substantially perpendicular to one of said side faces (22*a*, 22*b*) and a long axis perpendicular to said short axis, said wedge shape extending along a major part of said long axis;

providing a mandrel (26) having an axis and an arcuate radially outwardly directed mandrel surface (26*c*) for abutment of the edge face (22*c*) close to the wedge tip, and a substantially axially directed mandrel surface (26*a*) along said arcuate radially outwardly directed mandrel surface (26*c*) for abutment of one side face (22*a*) of the metal strip section (22); and rolling the metal strip section (22) around the mandrel (26) to form the arc element, the edge face (22*c*) close the wedge tip producing an internal circumference (12*c*) and the edge face (22*d*) remote from the wedge tip producing the external circumference (12*d*) over the arc element (12), the rolling step including providing roller means (32, 34) for acting upon each of the other side face (22*b*) and the edge face (22*d*) remote from the wedge tip, the roller means moving in common about the axis (A—A) of the mandrel (26), the roller means (32, 34) having a rolling action effecting a longitudinal stretching of the metal strip section along the length thereof, which stretching is at a maximum adjacent to the edge face (22*d*) remote from the wedge tip, and is reduced towards the edge face (22*c*) close to the wedge tip, the side faces (22*a*, 22*b*) inclined in wedge form towards one another being transformed into the substantially plane-parallel side faces (12*a*, 12*b*) of the arc element (12) by the stretching during rolling action of the roller means, the long axis of the cross-sectional area of the metal strip section (22) having a length at least 2.5 times longer than that of the short axis.

3. A method for producing a part-circular arc element (12), having a cross-sectional area which—considered in a section containing the axis of curvature—possesses a longer extent in the radial direction and a shorter extent in the axial direction and further having side faces (12*a*, 12*b*) which are perpendicular to the axis of curvature and are substantially plane-parallel, the method comprising the steps of:

providing a substantially rectilinear metal strip section (22) having two side faces (22*a*, 22*b*) inclined in a wedge form towards one another and having two edge faces (22*c*, 22*d*) connecting the side faces (22*a*, 22*b*), namely an edge face (22*c*) close to the wedge tip and an edge face (22*d*) remote from the wedge tip, the metal strip section (22) having a cross-sectional area with a short axis substantially perpendicular to one of said side faces (22*a*, 22*b*) and a long axis perpendicular to said short axis, said wedge shape extending along a major part of said long axis;

providing a mandrel (26) having an axis and an arcuate radially outwardly directed mandrel surface (26*c*) for abutment of the edge face (22*c*) close to the wedge tip, and a substantially axially directed mandrel surface (26*a*) along said arcuate radially outwardly directed mandrel surface (26*c*) for abutment of one side face (22*a*) of the metal strip section (22); and rolling the metal strip section (22) around the mandrel (26) to form the arc element, the edge face (22*c*) close the wedge tip producing an internal circumference (12*c*) and the edge face (22*d*) remote from the wedge tip producing the external circumference (12*d*) over the arc element (12), the rolling step including providing roller means (32, 34) for acting upon each of the other side face (22*b*) and the edge face (22*d*) remote from the wedge tip, the roller means moving in common about the axis (A—A) of the mandrel (26), the roller means (32, 34) having a rolling action effecting a longitudinal stretching of the metal strip section along the length thereof, which stretching is at a maximum adjacent to the edge face (22*d*) remote from the wedge tip, and is reduced towards the edge face (22*c*) close to the wedge tip, the side faces (22*a*, 22*b*) inclined in wedge form towards one another being transformed into the substantially plane-parallel side faces (12*a*, 12*b*) of the arc element (12) by the stretching during rolling action of the roller means, the long axis of the cross-sectional area of the metal strip section (22) having a length at least 2.5 times longer than that of the short axis, and further including providing a sliding metal coating (14) on the one side face (22) of the metal strip section abutting the axially directed mandrel surface (26*a*).

4. A method according to claim 1, 2, 3, including forming the metal strip section (25) by a leading end section of a longer metal strip, the rolling step being carried out on the metal strip section (22) while it is still connected with the longer metal strip, and subsequentially severing the rolled arc element (12) from the longer metal strip.

5. A method according to claim 4, wherein the severing of the arc element (12) takes place at a point $\beta$ of the metal strip where this has already experienced a curvature by a precedent rolling operation.

6. A method according to claim 1, 2, 3, wherein the strip providing step includes providing a metal strip (22) which is provided with a facette at at least one transition between a side face (22*a*, 22*b*) and an edge face (22*c*, 22*d*) so that in the rolling step this facette (22*e*, 22*f*) is shaped into a ring facette (12*e*, 12*f*) of the arc element (12).

7. A method according to claim 1, 2, 3, wherein the rolling step includes forming ring facettes (12*e*, 12*f*) on the metal strip section (22).

8. A method according to claim 2, wherein the severing step includes severing the arc element (12) from the longer metal strip by a cutting tool (46) which co-operates with counter-cutter faces (44) on the mandrel (26).

9. A method according to claim 4, wherein the severing step includes cutting the arc element (12) from the longer metal strip with a cutting tool (46) of such form so that desired end contours of the arc element are obtainable.

10. A method according to claim 1, 2, 3, and further comprising reshaping the arc element after the rolling step.

11. A method according to claim 10, and further comprising forming weld nipples (18) on the arc element (12) for securing to a bearing shell (10) after the rolling.

12. A method according to claim 10, and further comprising machining lubricating oil grooves (16), into at least one of the side faces (12*a*, 12*b*) after rolling, especially by a broaching operation.

13. A method for manufacturing a bearing shell having a cylindrical curved base member and at least one check flange (12) shaped as a part-circular arc element (12) with a cross-sectional area—considered in a section containing the axis of curvature—possessing a longer extent in the radial direction and a shorter extent in the axial direction, and the arc element (12) having side faces perpendicular to the axis of curvature and substantially plane-parallel, the method comprising the steps of:

providing a base member, providing;

at least one check flange; and fastening the at least one check flange to the base member, the check flange providing step including providing a substantially rectilinear metal strip section (22) having two side faces (22*a*, 22*b*) inclined in a wedge form towards one another and having two edge faces (22*c*, 22*d*) connecting the side faces (22*a*, 22*b*), namely an edge face (22*c*) close to the wedge tip and an edge face (22*d*) remote from the wedge tip, the metal strip section (22) having a cross-sectional area with a short axis substantially perpendicular to one of said side faces (22*a*, 22*b*) and a long axis perpendicular to said short axis, said wedge shape extending along a major part of said long axis, providing a mandrel (26) having an axis and an arcuate radially outwardly directed mandrel surface (26*c*) for abutment of the edge face (22*c*) close to the wedge tip, and a substantially axially directed mandrel surface (26*a*) along said arcuate radially outwardly directed mandrel surface (26*c*) for abutment of one side face (22*a*) of the metal strip section (22), and rolling the metal strip section (22) around the mandrel (26) to form the arc element, the edge face (22*c*) close the wedge tip producing an internal circumference (12*c*) and the edge face (22*d*) remote from the wedge tip producing the external circumference (12*d*) over the arc element (12), the rolling step including providing roller means (32, 34) for acting upon each of the other side face (22*b*) and the edge face (22*d*) remote from the wedge tip, the roller means moving in common about the axis (A—A) of the mandrel (26), the roller means (32, 34) having a rolling action effecting a longitudinal stretching of the metal strip section along the length thereof, which stretching is at a maximum adjacent to the edge face (22*d*) remote from the wedge tip, and is reduced towards the edge face (22*c*) close to the wedge tip, the side faces (22*a*, 22*b*) inclined in wedge form towards one another being transformed into the substantially plane-parallel side faces (12*a*, 12*b*) of the arc element (12) by the stretching during rolling action of the roller means.

14. A method for manufacturing a bearing shell having a cylindrical curved base member and at least one check flange (12) shaped as a part-circular arc element (12) with a cross-sectional area—considered in a section containing the axis of curvature—possessing a longer extent in the radial direction and a shorter extent in the axial direction, and the arc element (12) having side faces perpendicular to the axis of curvature and substantially plane-parallel, the method comprising the steps of:

providing a base member;

providing at least one check flange; and fastening the at least one check flange to the base member, the check flange providing step including providing a substantially rectilinear metal strip section (22) having two side faces (22*a*, 22*b*) inclined in a wedge form towards one another and having two edge faces (22*c*, 22*d*) connecting the side faces (22*a*, 22*b*), namely an edge face (22*c*) close to the wedge tip and an edge face (22*d*) remote from the wedge tip, the metal strip section (22) having a cross-sectional area with a short axis substantially perpendicular to one of said side faces (22*a*, 22*b*) and a long axis perpendicular to said short axis, said wedge shape extending along a major part of said long axis, providing a mandrel (26) having an axis and an arcuate radially outwardly directed mandrel surface (26*c*) for abutment of the edge face (22*c*) close to the wedge tip, and a substantially axially directed mandrel surface (26*a*) along said arcuate radially outwardly directed mandrel surface (26*c*) for abutment of one side face (22*a*) of the metal strip section (22), and rolling the metal strip section (22) around the mandrel (26) to form the arc element, the edge face (22*c*) close the wedge tip producing an internal circumference (12*c*) and the edge face (22*d*) remote from the wedge tip producing the external circumference (12*d*) over the arc element (12), the rolling step including providing roller means (32, 34) for acting upon each of the other side face (22*b*) and the edge face (22*d*) remote from the wedge tip, the roller means moving in common about the axis (A—A) of the mandrel (26), the roller means (32, 34) having a rolling action effecting a longitudinal stretching of the metal strip section along the length thereof, which stretching is at a maximum adjacent to the edge face (22*d*) remote from the wedge tip, and is reduced towards the edge face (22*c*) close to the wedge tip, the side faces (22*a*, 22*b*) inclined in wedge form towards one another being transformed into the substantially plane-parallel side faces (12*a*, 12*b*) of the arc element (12) by the stretching during rolling action of the roller means, the long axis of the cross-sectional area of the metal strip section (22) having a length at least 2.5 times longer than that of the short axis.

15. A method for manufacturing a bearing shell having a cylindrical curved base member and at least one check flange (12) shaped as a part-circular arc element (12) with a cross-sectional area—considered in a section containing the axis of curvature—possessing a longer extent in the radial direction and a shorter extent in the axial direction, and the arc element (12) having side faces perpendicular to the axis of curvature and substantially plane-parallel, the method comprising the steps of:

providing a base member;

providing at least one check flange; and fastening the at least one check flange to the base member, the check flange providing step including providing a substantially rectilinear metal strip section (22) having two side surfaces (22*a*, 22*b*) inclined in a wedge form towards one another and having two edge faces (22*c*, 22*d*) connecting the side faces (22*a*, 22*b*), namely an edge face (22*c*) close to the wedge tip and an edge face (22*d*) remote from the wedge tip, the metal strip section (22) having a cross-sectional area with a short axis substantially perpendicular to one of said side faces (22*a*, 22*b*) and a long axis perpendicular to said short axis, said wedge shape extending along a major part of said long axis, providing a mandrel (26) having an axis and an arcuate radially outwardly directed mandrel surface (26*c*) for abutment of the edge face (22*c*) close to the wedge tip, and a substantially axially directed mandrel surface (26*a*) along said arcuate radially outwardly directed mandrel surface (26*c*) for abutment of one side face (22*a*) of the metal strip section (22), and rolling the metal strip section (22) around the mandrel (26) to form the arc element, the edge face (22*c*) close the wedge tip producing an internal circumference (12*c*) and the edge face (22*d*) remote from the wedge tip producing the external circumference (12*d*) over the arc element (12), the rolling step including providing roller means (32, 34) for acting upon each of the other side face (22*b*) and the edge face (22*d*) remote from the wedge tip, the roller means moving in common about the axis (A—A) of the mandrel (26), the roller means (32, 34) having a rolling action effecting a longitudinal stretching of the metal strip section along the length thereof, which stretching is at a maximum adjacent to the edge face (22*d*) remote from the wedge tip, and is reduced towards the edge face (22*c*) close to the wedge tip, the side faces (22*a*, 22*b*) inclined in wedge form towards one another being transformed into the substantially plane-parallel side faces (12*a*, 12*b*) of the arc element (12) by the stretching during rolling action of the roller means, the long axis of the cross-sectional area of the metal strip section (22) having a length at least 2.5 times longer than that of the short axis, and further including coating the one side face (22*a*) of the metal strip section abutting the axially directed mandrel surface (26*a*) with a sliding metal coating (14).

16. A method for manufacturing a bearing shell according to claim 13, 14, 15, and further including providing the check flange in the shape of an arc element (12) with weld nipples (18) at the internal circumference (12*c*), the fastening step including welding the check flange to the base member by said weld nipples (18), said weld nipples (18) being obtained by reshaping with the check flange after the rolling action.

17. An apparatus for production of a part-circular arc element (12) having a cross-sectional area which—considered in a section containing the axis of curvature—possesses a longer extent in the radial direction and a shorter extent in the axial direction, the arc element (12) having side faces (12*a*, 12*b*) perpendicular to the axis of curvature and substantially plane-parallel, the arc element (12) being produced from a rectilinear metal strip section (22) having two side faces (22*a*, 22*b*) inclined in a wedge-form towards one another and having two edge faces (22*c*, 22*d*) connecting the side faces (22*a*, 22*b*), namely, an edge face (22*c*) close the wedge tip and an edge face (22*d*) remote from the wedge tip, the metal strip section (22) having a cross-sectional area with a short axis substantially parallel to one of the side faces (22*a*, 22*b*) and a long axis substantially perpendicular to the short axis, the apparatus comprising:

a rolling mandrel (26) having an axis with a radially directed mandrel surface (26*c*) for abutment with the edge face (22*c*) close to the wedge tip, of the material strip section (22), and a substantially axially directed annular surface (26*a*) for abutment of one side face (22*a*) of the metal strip section (22);

at least one first roller (32) arranged so as to act upon the other side face (22*b*) of the metal strip section (22);

at least one second roller (34) arranged so as to act upon the edge face (22*d*) remote from the wedge tip of the metal strip section (22); and a roller carrier for carrying the two rollers (32, 34), the roller carrier being pivotable about the mandrel axis (A—A) of the rolling mandrel (26), the first roller (32) being mounted on the roller carrier (30) about an axis (32*a*) substantially radially to the mandrel axis (A—A), and the second roller (34) being mounted on the roller carrier (30) about an axis (34*a*) directed substantially parallel to the mandrel axis (A—A), the roller carrier (30) being in operative connection with a rotary drive (38), said first roller (32) having a first rolling surface, and said second roller (34) having a second rolling surface, said second rolling surface having a distance from said radially directed mandrel surface (26*c*) at least 2.5 times larger than the distance of said first rolling surface from said axially directed annular mandrel surface (26*a*).

18. An apparatus according to claim 17, wherein at least one of the rollers (32, 34) is arranged with adjustable spacing from the respective mandrel surface (26*a*, 26*c*).

19. An apparatus according to claim 18, wherein at least one of the rollers (32, 34) is mounted on an eccentric (34*b*) and the eccentric (34*b*) is rotatable.

20. An apparatus according to claim 17, wherein the axes (32*a*, 34*a*) of rotation of the two rollers (32, 34) are arranged approximately in one common plane containing the axis (A—A) of the mandrel (26).

21. An apparatus according to claim 17, wherein with the mandrel (26) there is associated a metal strip feed apparatus (42) having a stationary tongs arrangement (42*a*) and a movable tongs arrangement (42*b*), which apparatus delivers the metal strip (22) to be worked tangentially to the mandrel (26), said feed apparatus being oriented so that said short axis of the cross-sectional area of the metal strip is substantially parallel to the mandrel axis, and said longer axis of cross-sectional area being substantially perpendicular to the mandrel axis, said feed apparatus being adapted to feed strip material having a cross-sectional area with a long axis having a length at least 2.5 times longer than the length of the respective short axis.

22. An apparatus according to claim 21 wherein with the mandrel (26) there is associated a cutting plunger (46) for cutting off the respective rolled arc element (12) from the longer metal strip (22).

23. An apparatus according to claim 22, wherein the cutting plunger (46) is movable substantially perpendicularly with respect to the axially directed annular mandrel surface (26).

24. An apparatus according to claim 23, wherein the cutting plunger (46) co-operates with counter-cutter edges (44) which are formed by an aperture in the axially directed annular mandrel surface (26).

25. An apparatus according to claim 24, wherein the aperture is filled out by a counter-holder plunger (50) which lies, in the rolling operation, with one end face flush with the axially directed mandrel surface (26*a*) and can be pressed back by the cutting plunger (46) in the cutting operation.

26. An apparatus according to claim 17, wherein on at least one of the mandrel (26) and the rollers (32, 34) there are provided facette-shaping faces (26*f*) which in the rolling form facettes on the produced arc element (12), or perform finishing work on facettes already preformed on the metal strip section (22).

* * * * *